United States Patent [19]

Dorn

[11] Patent Number: 4,692,739

[45] Date of Patent: Sep. 8, 1987

[54] CONTROL DEVICE USING LIGHT-EMITTING DIODES FOR BOTH MANUAL INPUT AND DISPLAY OF DATA

[75] Inventor: Alfred Dorn, Rodgau, Fed. Rep. of Germany

[73] Assignee: M.A.N.-Roland Druckmaschinen Aktiengesellschaft, Fed. Rep. of Germany

[21] Appl. No.: 750,673

[22] Filed: Jun. 27, 1985

[30] Foreign Application Priority Data

Jul. 3, 1984 [DE] Fed. Rep. of Germany ..... 3424412

[51] Int. Cl.[4] ..... G08C 21/00

[52] U.S. Cl. ..... 340/365 P; 250/221; 357/19

[58] Field of Search ..... 340/365 P, 365 R, 365 S, 340/712; 178/18; 179/90 K; 358/113, 41; 250/221, 213 A; 357/19

[56] References Cited

U.S. PATENT DOCUMENTS

| | | | |
|---|---|---|---|
| 3,340,401 | 9/1967 | Young | 340/365 P |
| 3,621,268 | 11/1971 | Friedrich et al. | 340/365 P |
| 3,737,668 | 6/1973 | Ellis et al. | 340/365 P |
| 3,860,754 | 1/1975 | Johnson et al. | 340/365 P |
| 4,049,964 | 9/1977 | Wuchinich et al. | 340/365 P |
| 4,514,817 | 4/1985 | Pepper et al. | 340/365 C |

FOREIGN PATENT DOCUMENTS

| | | | |
|---|---|---|---|
| 3306941 | 8/1984 | Fed. Rep. of Germany | 340/365 C |
| 8303691 | 10/1983 | Hungary | 340/712 |

OTHER PUBLICATIONS

T. F. Cummings—"Transparent Keyless Keyboard for Variable Terminal Applications"—*IBM Technical Disclosure Bulletin*—vol. 20, No. 4—Sep./77—pp. 1609–1611.

*Primary Examiner*—John W. Caldwell, Sr.
*Assistant Examiner*—Mahmoud Fatahi-Yar
*Attorney, Agent, or Firm*—Leydig, Voit & Mayer

[57] ABSTRACT

A light-emitting diode is used both for receiving data from an operator to change the logic state of a device and for displaying the entered data back to the operator. Current is selectively applied to the diode to display the data, but on an alternate basis the photo-current produced in the light-emitting diode by surrounding illumination is sensed and the data are received by detecting the fall-off in the photo-current caused by the operator covering the light-emitting diode. This technique is advantageously employed for the input and display of ink slide settings for a rotary printing machine by using a light-emitting diode matrix or bar graph display subject to finger-tip control by the operator. The diode matrix is scanned by repetitively and sequentially inhibiting the lighting current to the individual light-emitting diodes so that they may be sequentially connected to a photo-current monitoring circuit via a multiplexer under control of a clock circuit.

17 Claims, 7 Drawing Figures

CONTROL DEVICE USING LIGHT-EMITTING DIODES FOR BOTH MANUAL INPUT AND DISPLAY OF DATA

FIELD OF THE INVENTION

This invention relates generally to data display and input devices, and more particularly to a data input and display device in a control system for adjustment of the ink dosing elements in a rotary printing machine. Specifically, the invention relates to such a data input and display device having a control panel including a matrix of light-emitting diodes for display of ink slide displacements.

BACKGROUND OF THE INVENTION

In a rotary offset printing machine, it is well known to use an array of ink-dosing elements or slides arranged across the width of the printing machine for zonally regulating the density of ink printed on the printed sheet. The density of ink is increased or decreased by displacement of the ink slides under the control of an automatic ink feed control system. At the present time all of the major printing machine manufacturers sell automatic control systems for this purpose. A light-emitting diode matrix or bar graph display has been used in some of these systems for indicating the ink slide displacements.

In a known control system of this kind, as described in West German patent publication No. 3,147,312, a light pen is provided for entry of set-point data and control commands, and has a light receiver cooperating with the light-emitting diodes. For inputing each individual displacement value for a respective ink slide, a printer puts the light pen on the light-emitting diode corresponding to the value in the light-emitting diode row for the respective ink slide, and receives a light signal emitted by the light-emitting diode as a result of a short duration current pulse, the light signal being detected by an electronic control unit connected to the light pen and being evaluated for the adjustment of the respective ink slide. The light-emitting diode in proximity with the light pen is recognized by the fact that the light-emitting diodes receive the current pulses in a predetermined sequence. To enable the light-emitting diodes to be used for display purposes at the same time, the current pulses are so short in duration that the light-emitting diodes appear to the human eye to be non-illuminated or only weakly illuminated. Those light-emitting diodes which provide a display, on the other hand, are additionally given a relatively long current pulse which makes them appear to the human eye as brightly illuminated. The light pen is connected to operate only during the times of the short current pulses and cannot therefore detect the display pulses. A disadvantage of this kind of control system is that a light pen with a light receiver is required for entering set-point data and commands, and the light pen is connected to the control unit via a cable. The light receiver may, for example, be disturbed by stray light or reflections, and the cable can readily be damaged.

SUMMARY OF THE INVENTION

The primary object of the invention is to increase the reliability of data entry to a control system of the kind using light-emitting diodes for display of input data.

Another object of the invention is to simplify the entry of data to a control system of the kind having light-emitting diodes for display of input data.

A specific object of the invention is to eliminate the need for external input devices for a control system of the kind using light-emitting diodes for the display of data.

Briefly, according to the invention, any falloff in the photo-current produced in the light-emitting diodes by surrounding illumination is detected and evaluated as an input signal. For manual data entry, for example, the operator covers a selected light-emitting diode with his finger tip, causing the photo-current produced in the light-emitting diode to be interrupted, and the interruption in photo-current is detected by an electronic monitoring circuit. For the adjustment of ink slides in a printing machine, for example, the printer may set the displacement of a desired ink slide by covering a selected light-emitting diode in a row or column of light-emitting diodes corresponding to the desired ink slide. Thus by finger tip control the printer can input set-point data and control commands without the need for an additional device such as a light pen.

In accordance with another important aspect of the invention, the entry of data at a particular light-emitting diode is registered by turning on the same light-emitting diode. Illumination of the light-emitting diodes covered during data entry immediately shows the operator whether the input has been detected and evaluated.

In a preferred embodiment of the invention, a multiplexer under control of a clock circuit repetitively and sequentially connects each light-emitting diode to a monitoring circuit for detecting the photo-current and at the same time the light-emitting diode (which may have been turned on for display purposes) is temporarily disconnected from a lighting voltage source. Electronic switches are used to rapidly and reliably scan the light-emitting diodes for obtaining input data. According to an important aspect of the invention, the display of set-values already entered or actual-values occurring during operation of the control system are unaffected by the scanning or data entry process, because the time during which the light-emitting diodes are temporarily disconnected from the lighting voltage source is so short in duration that the temporary extinction of the light-emitting diodes cannot be perceived by the human eye.

In a preferred embodiment of the invention, each light-emitting diode is alternately connected by parallel switching circuits to the lighting voltage source or to the monitoring circuit. In this way all of the light-emitting diodes in a large matrix are monitored by the monitoring circuit.

According to another important aspect of the invention, in order to detect any fall-off in the photo-current of the light-emitting diodes, a current-to-voltage converter is connected in series with the monitoring circuit.

BRIEF DESCRIPTION OF THE DRAWINGS

Other objects and advantages of the invention will become apparent upon reading the attached detailed description and upon reference to the drawings in which.

Figure 1:
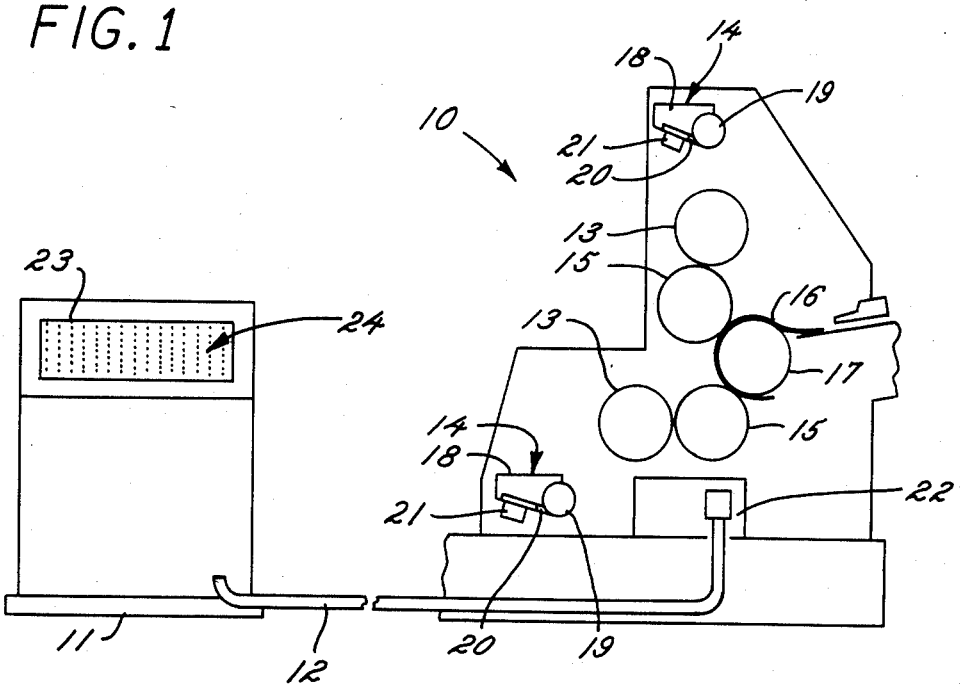
FIG. 1 is a schematic diagram of a rotary offset printing machine using the control system of the present invention for adjustment of the ink profile.

While the invention has been described in connection with the preferred embodiment, it will be understood that there is no intention to limit the invention to the particular embodiment shown but it is intended, on the contrary, to cover the various alternative and equivalent forms of the invention included within the spirit and scope of the appended claims.

DESCRIPTION OF THE PREFERRED EMBODIMENT

Turning now to the drawings, there is shown a schematic diagram of a rotary offset printing machine generally designated 10 and a data input and display unit 11 according the present invention which are interconnected by a cable 12. The printing machine 10 includes two printing units each having a plate cylinder 13 which is fed with printing ink via rollers (not shown) of a respective inking unit generally designated 14. Blanket cylinders 15 transfer the ink from the plate cylinders 13 to the paper 16 being printed. The paper 16 passes between the blanket cylinder 15 and impression cylinder 17.

The inking units 14 are of conventional construction and are of the kind including a duct 18 cooperating with a duct roller 19 to define a reservoir of ink. In order to zonally adjust an ink profile across the width of the printing machine, the flow of ink from each inking unit 14 is regulated by an array of ink dosing elements or slides 20 disposed at the base of the duct 18 and which are individually displacable with respect to the duct roller 19. The ink slides are automatically displaced by actuators 21 such as stepper motors in order to set a desired gap between the duct roller 19 and the end of each ink slide 20 abutting against the duct roller. The width of the gap defines the amount of ink transferred from the ink duct 18 to the respective plate cylinder 13.

The actuators 21 are adjusted in the conventional manner by a position adjusting microcomputer 22 as described, for example, in Schramm et al. U.S. Pat. No. 4,200,932 issued Apr. 29, 1980. The position adjusting microcomputer 22 receives, via the cable 12, set-point values from the data input and display unit 11. For the entry and display of ink density set-point values, the data input and display unit 11 includes a control panel 23 comprising a matrix 24 of light-emitting diodes. The data input and display unit 11 is also used in the conventional manner as a control panel for a number of other machine functions, for example, for control of printing register.

Figure 2:
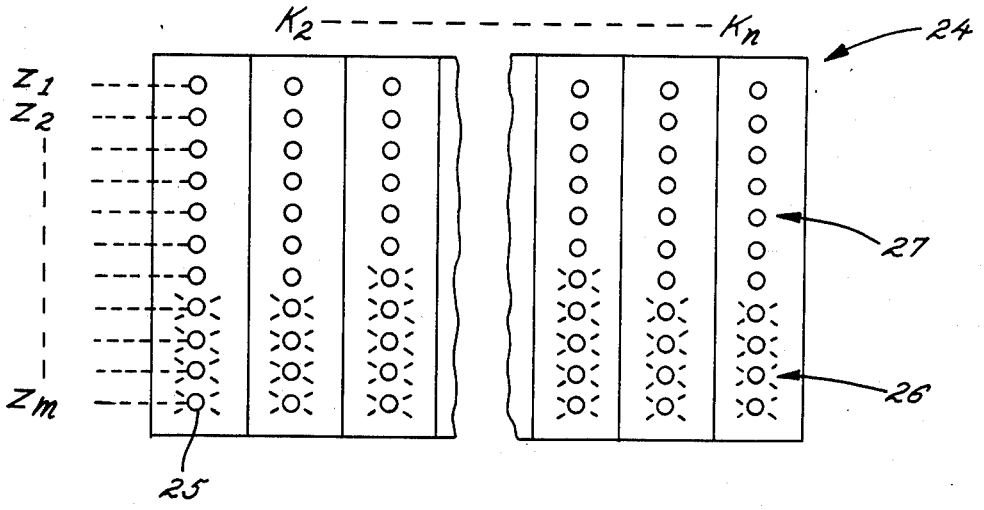
FIG. 2 is a detailed pictorial diagram of the light-emitting diode matrix in the control panel of the control system.

Turning now to FIG. 2, the matrix 24 of light-emitting diodes 25 is shown in greater detail. In order to provide a graphic display of the displacement of the ink slides 20, the matrix 24 has a particular column $k_1$ to $k_n$ for each of the n ink slides 20 in a single one of the inking units 14. For simplification, the matrix 24, at any given time, serves to enter or display ink slide displacements for a selected one of the inking units 14. Each of the m rows in the matrix corresponds to a discrete gradation of ink slide displacement. Each gradation, in other words, represents a specific level of ink density printed on the printed sheet 16. It should be noted, however, that the actual displacement of the ink slides need not have a precise linear relationship to the levels of ink density, for example, the levels could correspond to displacement offsets from preselected reference positions. As further shown in FIG. 2, the matrix 24 could give a kind of bar graph display including segments of illuminated 26 and non-illuminated 27 light-emitting diodes 25. The non-illuminated diodes 27, for example, represent the gap between the ink slides 20 and their respective duct roller 19. Alternatively, for example to conserve lighting power, only one diode in each column could be illuminated such as the uppermost diode shown illuminated in FIG. 2 in each column of the matrix 24.

Figure 3:
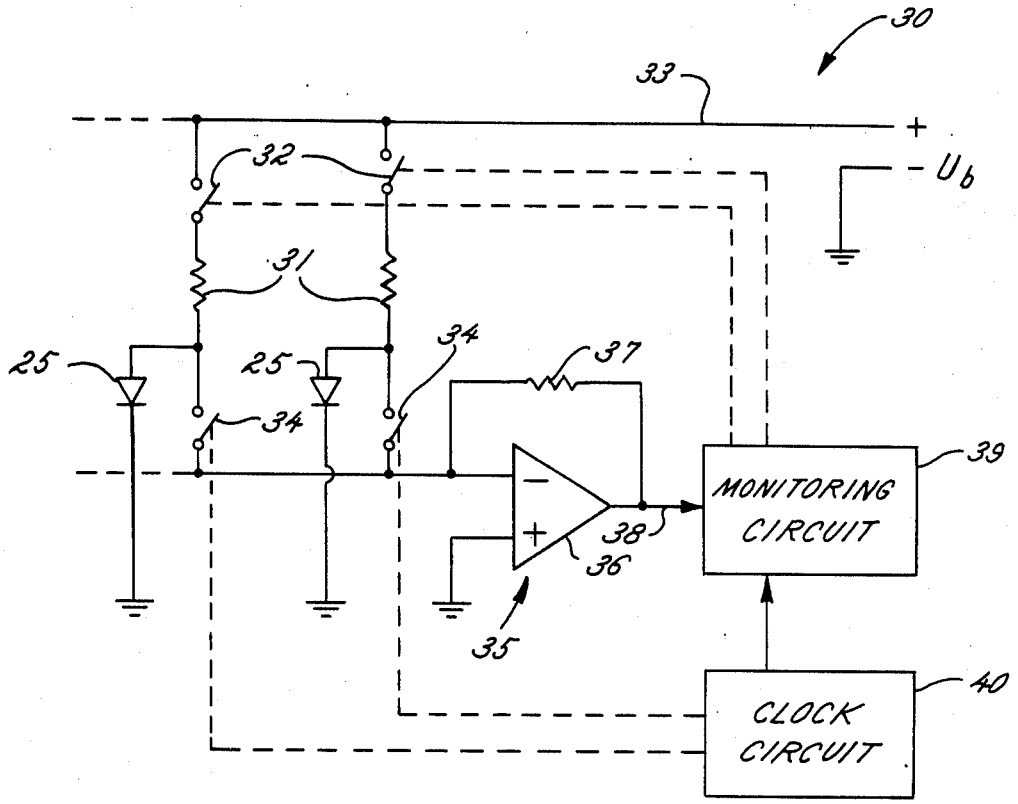
FIG. 3 is a simplified block diagram of a control system of the present invention.

Turning now to FIG. 3 there is shown a simplified schematic diagram generally designated 30 showing how the light-emitting diodes 25 are used for both entering and displaying data such as control commands and set-points. For illustration purposes, only two light-emitting diodes 25 are shown. Each of the light-emitting diodes 25 is connected in series with a current limiting resistor 31 and a switch 32 connected to a live conductor 33 fed with the required lighting voltage $U_b$. In parallel with the respective resistor 31 and switch 32, each light-emitting diode 25 is connected via a switch 34 to the input of a current-to-voltage converter generally designated 35 including an operational amplifier 36 and a negative feedback resistor 37. The negative input of the operational amplifier 36 provides the input of the current-to-voltage converter 35 and the positive input of the operational amplifier 36 is grounded. Therefore, assuming that the input offset voltage of the operational amplifier 36 is minimal, the input current to the current-to-voltage converter 35 passes through the resistor 37 due to the negative feedback, and therefore the (negative) voltage on the output 38 which appears across the resistor 37 is proportional to the input current. It should be noted that according to the photovoltaic effect, the illumination of a semiconductor p-n junction causes a forward voltage drop across the junction, so that the photo-current flows in the reverse direction across the junction. Therefore, the photo-current from the light-emitting diodes cause a negative voltage at the output 38 of the current-to-voltage converter.

The output of the current-to-voltage converter 35 is fed to a monitoring circuit 39 which evaluates the voltage at the output 38 of the converter 35. The monitoring circuit 39 also receives signals from a clock circuit 40, which repetitively closes the switches 34 in a predetermined sequence.

In order to selectively turn on the individual light-emitting diodes 25 to display data such as entered set-values or existing actual-values, the corresponding switches 32 are closed under control of the monitoring circuit 39. The light-emitting diodes 25 corresponding to the data to be displayed are then connected to the lighting voltage $U_b$ and are illuminated. The resistors 31 regulate the current applied to their respective light-emitting diodes 25 when their respective switches 32 are closed.

To enable data to be entered at any time, the clock circuit 40 repetitively and sequentially opens and closes the switches 34. When a switch 34 for a light-emitting diode 25 is closed, the switch 32 associated with this light-emitting diode is temporarily open to disconnect the light-emitting diode from the lighting voltage 33. The switching times are so short in duration that the human eye does not perceive the extinction of the light-emitting diode. When the switch 32 is open and the switch 34 is closed for a particular light-emitting diode 25, the illumination surrounding the light-emitting diode causes a photo-current to flow from the light-emitting diode to the current-to-voltage converter 35. The monitoring circuit 39 receives the corresponding voltage from the converter output 38, and recognizes the build-up of the (negative) voltage during the closed phase of the switch 34 as the non-input of data corresponding to the light-emitting diode selected for evaluation at that time by the clock circuit 40.

Figure 4:
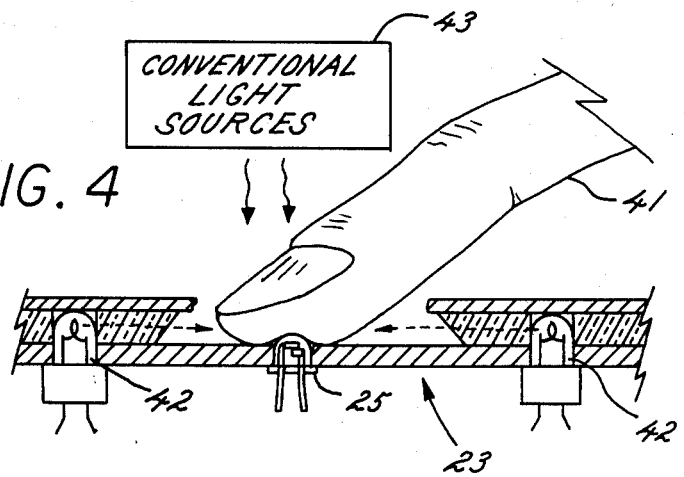
FIG. 4 is a pictorial diagram showing a light-emitting diode being covered by the finger tip of an operator, and further illustrating illumination of the light-emitting diode by conventional light sources apart from the control panel or by light sources associated with the control panel.

The entry of data is illustrated in FIG. 4. To adjust the displacement of an ink slide to a selected level, the printing machine operator uses his finger 41 to cover the light-emitting diode 25 in the column k and row z corresponding to the ink slide to be adjusted and the ink density level to be selected, respectively. As a result, the selected light-emitting diode 25 is shielded from the surrounding illumination, so that on closing of the corresponding switch 34 no substantial photo-current is produced in the light-emitting diode. Therefore, at this time a corresponding (negative) voltage does not build-up at the output 38 of the current-to-voltage converter 35, and in response the monitoring circuit 39 recognizes the entry of an adjustment command. As specifically described below in connection with FIG. 5, the monitoring circuit 39 responds to the entry of the command by activating the corresponding switch 32 so that the light-emitting diode covered by the operator becomes illuminated to display the input command.

As shown in FIG. 4, the illumination surrounding the light-emitting diode could be provided by light sources such as incandescent bulbs 42 built into the control panel 23. The incandescent bulbs 42 could, for example, ensure that the light-emitting diode 25 is surrounded by a relatively constant level of illumination. As further described below, however, the monitoring circuit 39 can be constructed to be relatively insensitive to the actual level of the surrounding illumination. Therefore, conventional light sources 43 apart from the control panel 23 may provide the illumination surrounding the light-emitting diode 25. The conventional light sources 43, for example, are overhead lights.

To enable just one light-emitting diode 25 to be covered by one finger 41 without any great skill, the distance between the light-emitting diodes 25 should correspond at least to the diameter of the finger tip. Auxiliary means could be used, however, to cover the light-emitting diodes. For certain recurring adjustments, for example, templates aligned with the control panel 23 could be used to cover selected light-emitting diodes. As further described below, however, recurring adjustments could be stored electronically in computer memory.

The present invention has been described for the entry of ink density set-values on a rectangular matrix of light-emitting diodes. In this case the display provided by the matrix is analogous to the ink slide displacements. For other kinds of data entry, however, the light-emitting diodes could be arranged according to any desired format. Alphanumeric labels, for example, could be provided for indicating the command function associated with a particular light-emitting diode. For a printing machine, additional light-emitting diodes could be labelled and set aside for the control of register adjustment or for adjusting dampening units (not shown) associated with the printing machine. Although these commands could be diverse from the ink slide settings, electronically the light-emitting diodes associated with these other commands could be treated as an additional column of the diode matrix.

Figure 5:
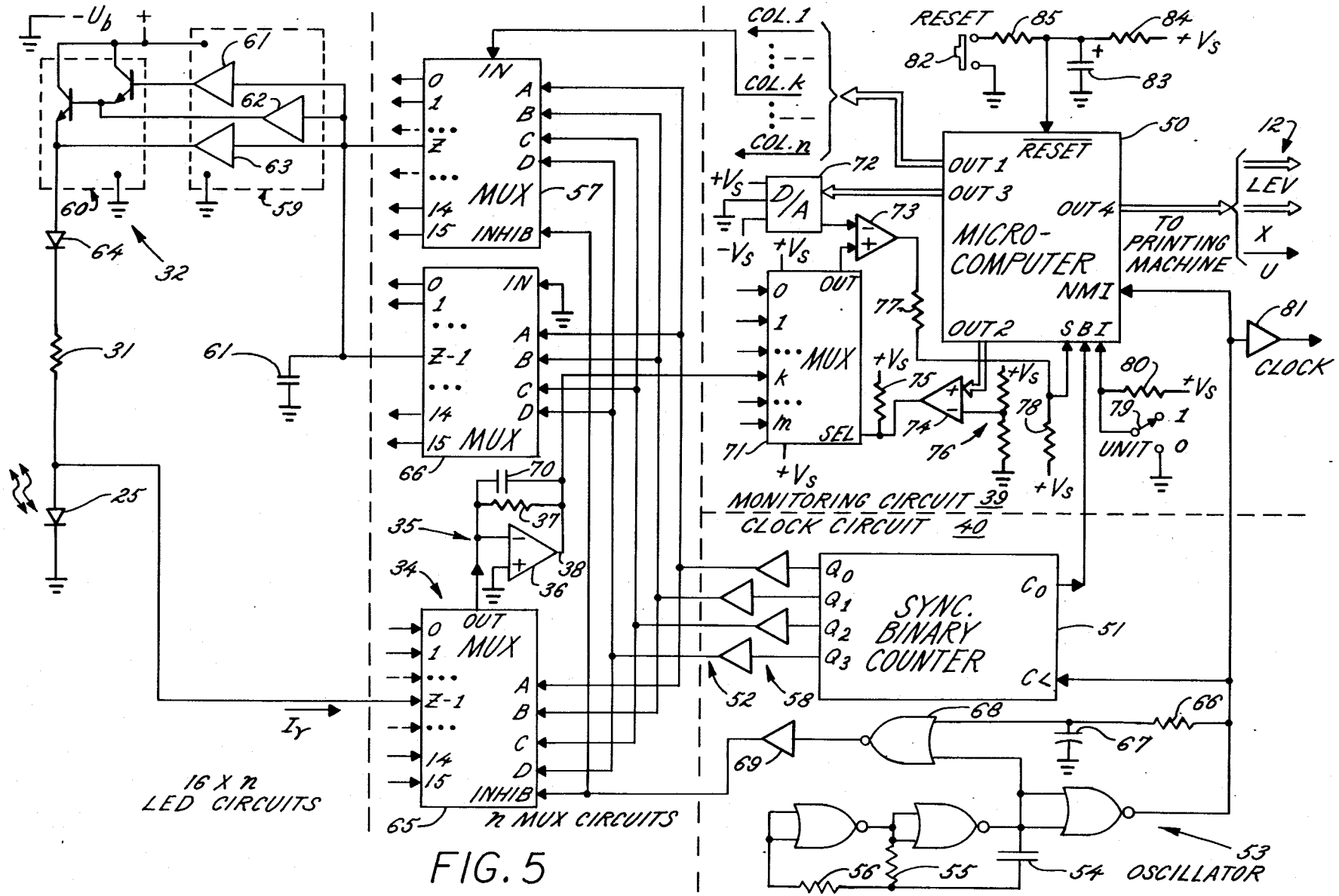
FIG. 5 is a detailed schematic diagram of a preferred embodiment of the control system which uses a microcomputer in the monitoring circuit.

Turning now to FIG. 5, there is shown a detailed schematic diagram of a preferred embodiment of the present invention. This preferred embodiment assumes that all of the light-emitting diodes 25, regardless of their function, are electronically arranged in a rectangular matrix. This electronic arrangement simplifies the opening and closing of the lighting current switches 32 and the photo-current switches 34 via row and column addressing of the matrix. As a further simplification, the clock circuit 40 addresses both the lighting current switches 32 and the photo-current switches 34. From FIG. 5, it is recognized that this further simplification is made possible by using a microcomputer 50 as an important part of the monitoring circuit 39. The microcomputer 50 is synchronized to the addressing or scanning by the clock circuit. By using the microcomputer, an image table or array is provided in the computer's memory to store the desired states of the lighting current switches 32. The microcomputer 50 has a first set of output lines (OUT1) providing a separate binary signal for each column k of the matrix. This binary signal specifies whether the light-emitting diode 25 in the particular row z addressed by the clock circuit 40 should be turned on or off.

As shown in FIG. 5, the clock circuit 40 includes a synchronous binary counter 51 providing a row address signal on a set of 4 address lines generally designated 52. The synchronous binary counter is, for example, a standard CMOS part number 4029. The outputs $Q_3$, $Q_2$, $Q_1$, $Q_0$ specify a four-bit binary row address number z. Therefore it is apparent that the number of rows m is 16 for the circuit shown in FIG. 5. The binary counter 51 is clocked by an oscillator generally designated 53 comprised of standard CMOS NOR gates, which are standard CMOS part number 4001. The oscillator 52 includes a frequency setting capacitor 54 and associated resistors 55 and 56. The resistance and capacitor values are selected to obtain a frequency of oscillation of about 400 hertz. This particular frequency sets a scanning rate of 25 hertz for the entire matrix and a duration of 2.5 milliseconds for inhibiting the lighting current and evaluating the photo-current from an individual light-emitting diode. The resistors 55 and 56, for example, have a value of 150 K ohms, and the capacitor 53, for example, has a value of 0.01 microfarads.

In order to address the lighting current switches 32, the address lines 52 from the counter 51 are applied to the select inputs of a multiplexer 57 provided for each column of the matrix 24. The multiplexer 57 is, for example, standard CMOS part number 4067. Each output of the multiplexer 57 is fed to the switch 32 for a particular light-emitting diode 25. Due to the relatively large number of multiplexers addressed by the counter 51, buffers 58 drive the address lines 52. The buffers 58 are included in a standard CMOS integrated circuit part no. 4050.

As shown FIG. 5, each lighting current switch 32 is comprised of drivers 59 and transistors 60. The drivers 59 are included in a CMOS integrated circuit part number 4050, and the transistors 60 are included in a single integrated circuit such as RCA Corp. part number CA3724G. The transistors in the circuit 59 are connected as a Darlington pair to achieve sufficient power gain for switching up to a maximum rated current of 1 ampere. A single transistor could source up to about 100 milliamperes. Since the diode matrix 24 is scanned row-by-row and there are 16 rows, the maximum average lighting current to a single light-emitting diode in response to the multiplexer 57 alone is only about 80 milliamperes. To avoid this current limitation, the duty cycle of the switch 59 is increased to more than 90% by a dynamic memory capacitor 61 having a value of about 0.01 microfarads.

The driver integrated circuit 59 includes a first driver 61 for sourcing current to the transistors 60. The driver integrated circuit 59 also provides drivers 62, 63 for sinking as well as sourcing current. In order to achieve an extremely low leakage current, a silicon directional diode 64 is placed in series with the current limiting resistor 31 so as to provide a high resistance path to block the flow of leakage current to the light-emitting diode 25 when the transistors 60 are turned off. Therefore, the leakage current is sinked to ground by the drivers 62 and 63. It is important to have low leakage currents because the the light-emitting diode 25, even in the strongest surrounding illumination, will have a photo-current on the order of one or more microamperes. The total current $I_y$ fed to the current-to-voltage converter 35 includes both the photo-current of the light-emitting diode 25 and any leakage current from the switch 32 which passes through the directional diode 64. Therefore, a very low leakage current is necessary so that the photo-current is not overwhelmed by the leakage current.

The value of the current limiting resistor 31 is selected taking into account the voltage drop across the transistors 60, the directional diode 64 and the light-emitting diode 25 when the light-emitting diode is illuminated. For a 5 volt lighting voltage, for example, the resistor 31 should have a value of 10 ohms to provide a lighting current of about 250 milliamperes.

The photo-current switches 34 are provided by a second analogue multiplexer 65. The second analogue multiplexer is again a 16 channel multiplexer, standard CMOS part no. 4067. For each light-emitting diode 25, the photo-current $I_y$ is received during the phase immediately preceding the phase for which the first multiplexer 57 refreshes the dynamic memory capacitor 61. In other words, if z denotes the analogue channel from the first multiplexer 57 for a particular light-emitting diode 25, then the photo-current $I_y$ is received on the z minus 1, modulo 16, analogue channel of the second multiplexer 65.

To temporarily inhibit the lighting current for each light-emitting diode 25 when the diode's photo-current $I_y$ is fed to the current-to-voltage converter 35, a third multiplexer 66 is provided to discharge the dynamic memory capacitor 61 so that the switching transistors 60 disconnect the light-emitting diode 25 from the lighting voltage $U_b$ when the multiplexer 65 selects the photo-current $I_y$. It is further desirable for the multiplexer 65 to be inhibited until sufficient time has passed for the transistors 60 to turn completly off. For this purpose, an inhibit signal is generated by a timing circuit including a resistor 66, a capacitor 67, and a NOR GATE 68. The resistor 66 has a value, for example, of 100 K ohms and the capacitor 67 has a value of 1000 picofarads to give an inhibit time of about 90 microseconds. The buffer 69 drives the inhibit input of the multiplexer 65, as well as the inhibit input of the multiplexer 57. During the time that the multiplexer 57 is inhibited, the microcomputer 50 updates the input to the multiplexer 57 for the row z newly selected by the clock circuit 40.

It should be apparent that the inhibit signal is applied to the first and second multiplexers 57, 65 immediately prior to a change in the address from the clock circuit 40. When the clock circuit 40 generates a clock address of z minus 1, the multiplexer 66 discharges the dynamic memory capacitor 61 so as to turn off the lighting current from the transistors 60, assuming, of course, that the light-emitting diode 25 had been illuminated. The inhibit signal continues for about 90 microseconds, so that the transistors are turned fully off. At the end of 90 microseconds, the multiplexer 65 is no longer inhibited and the current $I_y$, including the photo-current and any leakage current, is applied to the current-to-voltage converter 35. During the 90 microsecond inhibit time, the voltage on the output 38 of the current-to-voltage converter 35 approaches its zero value, so that the current-to-voltage converter 35 is ready to receive the photo-current from the newly addressed light-emitting diode 25.

The current-to-voltage converter 35, therefore, has left approximately 2.4 milliseconds with which to sample the photo-current. Preferably, the current-to-voltage converter 35 includes a negative feedback capacitor 70 so that the response time of the current-to-voltage converter is increased to a substantial fraction of the 2.4 millisecond sample interval, so as to reject any high frequency noise received by the operational amplifier 36. It is desirable, however, that the time constant of the capacitor 70 and feedback resistor 37 is rather small compared to the 2.4 millisecond sample interval so that a relatively inexpensive successive approximation analogue-to-digital conversion may be performed by the microcomputer 50 without also using a sample-and-hold circuit. The analogue-to-digital conversion takes place approximately 1.5 microseconds within the sample interval. Therefore, the current-to-voltage converter 36 should reach a stable value after this time, thereby requiring a time constant of approximately 200 microseconds. The operational amplifier 36 preferably is of the kind having a MOS/FET input such as RCA Corporation part no. CA3140. The value of the resistor 37 is selected in accordance with the photo-current producing ability of the light-emitting diode 25 and the expected level of ambient illumination. Even for the strongest ambient illumination, the photo-current from the light-emitting diode 25 will not exceed a few microamperes. Therefore, the resistor 37 should have a value on the order of one megohm. To obtain the 200 microsecond time constant for the one megohm resistor, the capacitor 70 should have a value of 200 picofarads. A one megohm resistance provides a conversion factor of one millivolt of voltage for each nanoampere of photo-current.

The output 38 of the current-to-voltage converter 35 is fed to a respective input k of a fourth multiplexer 71 used as an input selector to a successive-approximation analogue-to-digital converter circuit including a digital-to-analogue converter 72 and a high speed comparator 73. The multiplexer 71 is, for example, standard CMOS part no. 4067, the same as the other three multiplexers 57, 66 and 65. Due to the negative voltage provided by the current-to-voltage converter, the multiplexer 71, in contrast to the other logic components of the circuit in FIG. 5, should be operated between plus and minus supply voltage, with $V_{DD}$ at $+V_s$, and $V_{SS}$ at $-V_s$. The operational amplifier 36 as well as the high speed comparator 73 and digital-to-analogue converter 72 also operate with positive and negative supply voltages. The high speed comparator 73 is, for example, RCA part no. CA311, and the digital-to-analogue converter is Signetics Corp. part No. LMDAC08CN. The inputs and outputs of the microcomputer 50 are assumed to fall within zero to 5 volts. Therefore, a quad comparator 74, such as RCA part no. CA339, is used for level conversion to interface a second set of output lines OUT3 of the microcomputer 50 to the select input of the multiplexer 71. The quad comparator 74 uses pullup resistors 75, for example 10 K ohms, and a reference voltage divider generally designated 76 including two 10 K ohm resistors. The output of the high speed comparator 73 is similarly interfaced to a single bit input (SBI) of the microcomputer 50 via a voltage divider including two 10-K-ohm resistors 77 and 78.

The digital-to-analogue converter 72, part No. LDMAC08CN, is designed to interface directly to a third set of output lines OUT3 from the microcomputer 50, and also provides a negative voltage output.

In order to select the diode matrix 24 (see FIGS. 1 and 2) for entering and displaying data for either a first or second one of the inking units 14, one of the single bit inputs receives a signal from a unit selector switch 79. The switch 79 shunts the input to ground for a low logic level, and a pullup resistor 80 of 10-K-ohms provides the high logic level.

The microcomputer 50 has a fourth set of output lines OUT4 for transmitting ink adjustment data to the printing machine 10 (see FIG. 1) over the cable 12. For a short cable 12, it is convenient to transmit these data in parallel form including lines for designating a selected one of 16 levels, lines designating the ink slide (x) to be adjusted and a line U designating whether the adjustment is for the first or second of the inking units 14. These data are synchronized to a clock signal obtained via a buffer 81 driven by the oscillator 53. The buffers 58, 69 and 81 are all provided in the same integrated circuit, standard CMOS part no. 4050. The microcomputer 50 is synchronized to the oscillator 53 via the same clock signal being applied to the microcomputer's non-maskable interrupt input (NMI)

The microcomputer 50 also has a reset switch 82 for initially setting the ink adjustments to predetermined values and for commanding the microcomputer 50 to read and store the level of ambient illumination surrounding each of the light-emitting diodes 25. These values of ambient illumination also take into account any leakage currents or offset voltages associated with each individual light-emitting diode. For the purpose of sensing covering of the light-emitting diodes, threshold levels are computed for each light-emitting diode so as to fall below the corresponding level of illumination. As is conventional, a power-on-reset circuit is also used including a capacitor 83, and resistors 84 and 85. The capacitor 83 is, for example, a one microfarad capacitor, the resistor 84 has a value of 100 K ohms and the resistor 85 has a value of 220 ohms.

Figure 6:
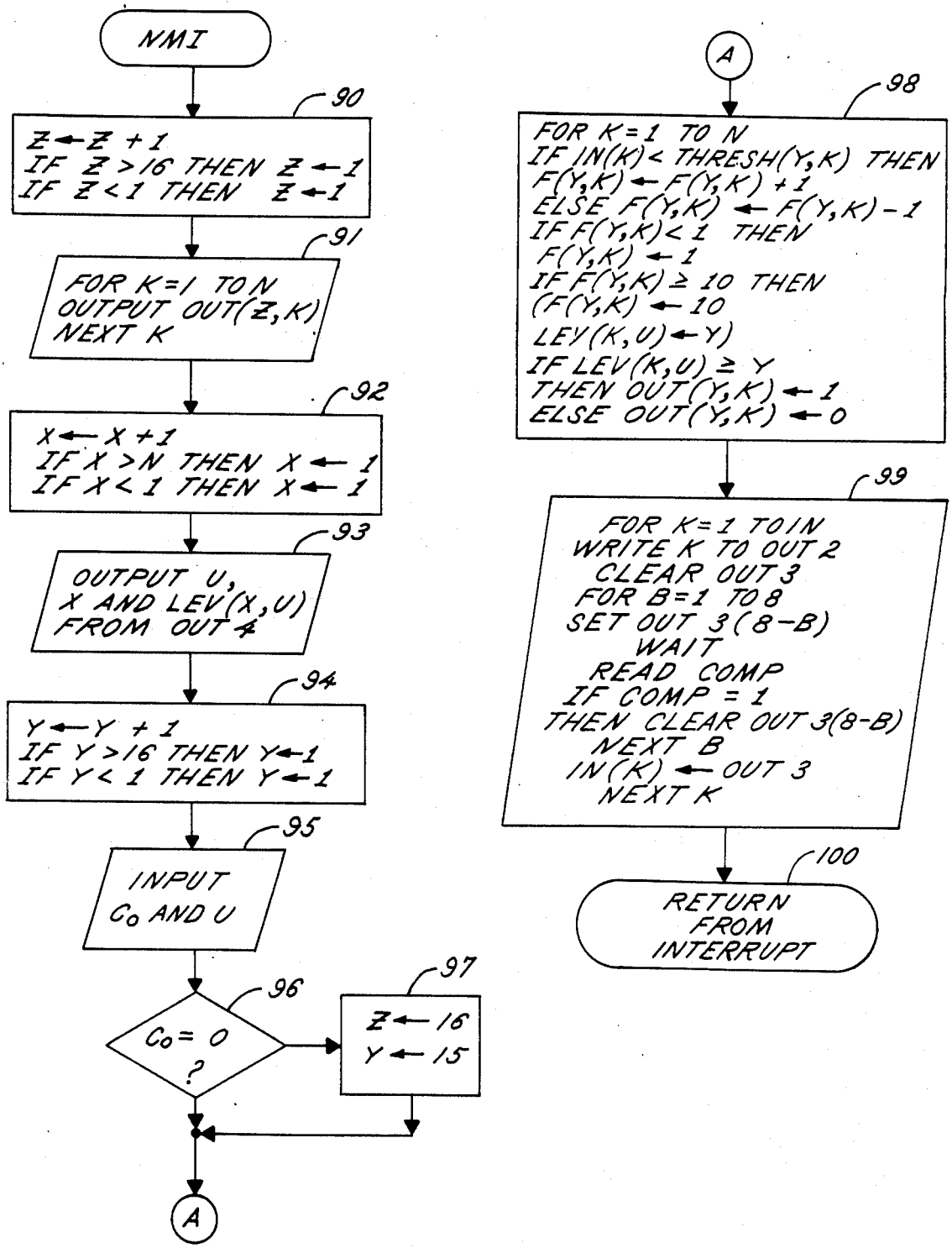
FIG. 6 is a flowchart of a non-maskable interrupt procedure executed by the microcomputer in FIG. 5.

Turning to the FIG. 6, there is shown a flowchart of the non-maskable interrupt procedure which is executed during each sample interval in response to a transition on the clock signal from the oscillator 53. So that the microcomputer 50 knows which row of the matrix 24 is being addressed, in the first step 90 an index counter Z is incremented in modulo-16 fashion. Specifically, the index Z is first incremented, and is then compared to 16. If the index Z exceeds 16, it is set to 1. Also, so that the index Z will never be outside the range of 1 to 16, the index Z is compared to 1 and if it is less than 1, it is set equal to 1. In step 91, the capacitors 61 for an entire row of the matrix 24 are refreshed. The logic state of each individual bit is transmitted from the microcomputer 50 to the N multiplexers 57. In practice, the microcomputer 50 is an 8 bit microcomputer so that step 91 is advantageously performed by outputting a number of bytes. The bits or bytes are obtained from an array OUT(Z,K) in the microcomputer's memory. The array OUT(Z,K) is set to certain values in step 98 as described below.

In step 92, a second index counter X is incremented in modulo N fashion. This second index counter X is used to address an array LEV(X,U) of the displacement-set values for the N slides in both the first and second inking units 14 (see FIG. 1) as selected by the logical flag U. In step 93, the logical flag U, the index X and the ink density set-value from the array LEV(X,U) is transmitted from the microcomputer's fourth set of output lines. From the fourth set of output lines, these signals travel via the cable 12 to the printing machine 10.

A third index counter Y is used to address an array THRESH (Y, K) of threshold values, and another array F(Y,K) accumulating a number of times, up to a maximum of ten, that the surrounding illumination of each light-emitting diode falls below its corresponding threshold level. In step 94, this third index Y is incremented in modulo-16 fashion and is limited to fall within the range of 1 to 16. As should become evident below, the index Y is in effect the modulo-16 difference between the index Z and 1.

In step 95, the single bit inputs $C_o$ and U are read by the microcomputer. The indices Z and Y are synchronized to the value of the binary counter 51 (see FIG. 5) by first comparing the carry-out $C_0$ to 0 in step 96, and if the carry-out $C_0$ is equal to 0, then in step 97 the value of the index Z is set to 16, and the value of the index Y is set to 15.

So that the monitoring circuit 39 will not respond to "popcorn" noise or static discharges, the intensity of the illumination surrounding the light-emitting diode 25 must fall below the corresponding threshold on the average of ten times before the monitoring circuit 39 will conclude that the light-emitting diode has been covered for the entry of data. Specifically, for each of the N light-emitting diodes in each row, the received intensity, stored in an array IN(K) is compared to its respective threshold value in the array THRESH(Y,K). If the intensity falls below the corresponding threshold, then the value of a corresponding filter array F(Y,K) is incremented. Otherwise, the corresponding element in the filter array F(Y,K) is decremented. The value of the filter array is limited to between 1 and 10. If the value of the respective element in the filter array F(Y,K) reaches 10, then the entry of data is recognized by setting the corresponding element LEV(K,U) of the level array to the value of the third index Y. In other words, if the operator covers a chosen light-emitting diode, that covering will be interpreted as a command to set the setpoint of the ink slide for the chosen column to a level or setvalue corresponding to the selected row of the matrix 24. The entry of this command is further indicated by generating or updating a bar graph display.

To generate the bar graph display, the value of the corresponding element of the level array LEV(K,U) is compared to the value of the third index Y. If the value of Y is exceeded, then the corresponding light-emitting diode is turned on, which is performed by setting the corresponding element of the array OUT(Y,K) to 1. The array OUT(Y,K), in other words, is an image table of the logic states displayed by the light-emitting diodes 25. If the value of the corresponding element of the level array LEV(K,U) is less than the value of the third index Y, then the corresponding light-emitting diode should be turned off, which is performed by clearing the corresponding element in the array OUT(Y,K).

During the time that steps 94 to 98 were being performed, the current-to-voltage converter 36 was sampling the photo-current from the light-emitting diode 25. At step 99 in the non-maskable interrupt procedure of FIG. 6, approximately 1.3 milliseconds should have elapsed since the time that the interrupt was triggered by the clock signal from the oscillator 53. At this point, the microcomputer 50 performs a successive approximation analogue-to-digital conversion of the voltage on the output 38 of each of the N current-to-voltage converters 35 which have been sampling the photo-current from each of the N light-emitting diodes 25 in the Zth row of the light-emitting diode matrix 24. In order to convert the voltage from a selected one of the current-to-voltage converters 35, value of the index K is written to the second set of output lines OUT2 for the microcomputer 50 so that the multiplexer 71 selects the output 38 of the Kth current-to-voltage converter 35. Then a conventional successive-approximation conversion procedure is carried out by clearing the third set of output lines OUT3 feeding the digital-to-analogue converter 72, and then for each of the eight bits of the digital-to-analogue converter 72, starting with the most significant bit and proceeding to the least significant bit, setting the particular bit, waiting a sufficient period of time for the voltage comparison to occur, such as one or two execution cycles of the microcomputer 50, reading the value of the comparator received on one of the signal bit inputs (SBI), and if the logic state of the comparator 73 is high, then clearing that particular bit. It is assumed that the polarity of the digital-to-analogue converter 72 is such that as the bits become set, the output of the digital-to-analogue converter becomes more negative, so that the value on the third set of output lines will be proportional to the light intensity surrounding the corresponding light-emitting diode. Therefore, the final value on the third set of output lines OUT3 is stored in the respective Kth element of the light intensity array IN(A). The interrupt procedure is completed in step 100 by execution of a "Return From Interrupt" instruction.

Figure 7:
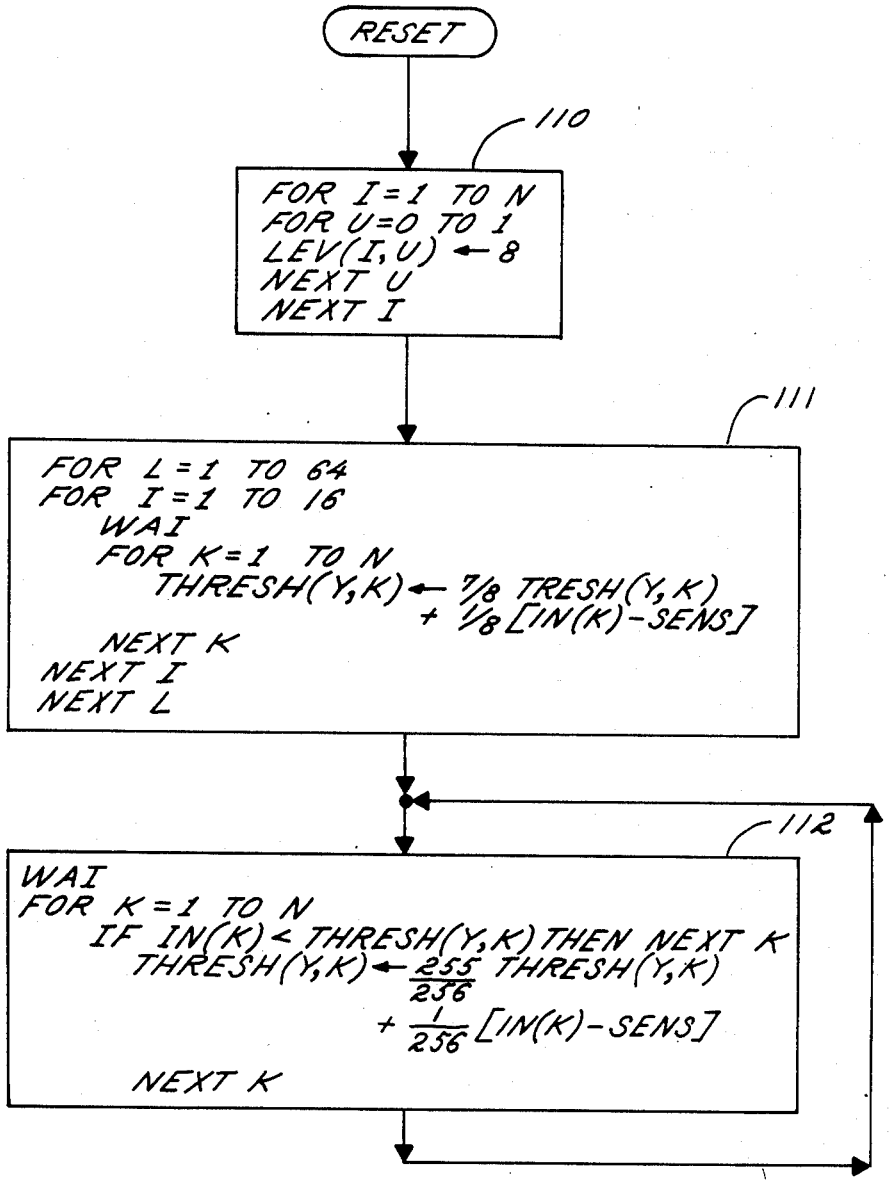
FIG. 7 is a flowchart of a reset procedure for the microcomputer in FIG. 5.

Turning now to FIG. 7, there is shown a flowchart of a reset procedure which is executed by the microcomputer 50 in response to activation of the reset switch 82 (see FIG. 5). In the first step 110, the level array LEV-(I,U) is set to predetermined initial values. As shown, for example, all of the levels are initially set to a mid-range value of 8.

Next, in step 111, intensity threshold values are determined for each of the light-emitting diodes 25 in the matrix 24. To eliminate noise, the threshold value is computed by a digital filter having a "time constant" of 8 intensity samples. To compute the threshold, a predetermined sensitivity SENS is subtracted from the corresponding intensity value IN(K). The digital filter is a first-order filter employing the factors of $\frac{7}{8}$ and $\frac{1}{8}$. It should be noted that the microcomputer 50 need not perform multiplications and divisions; rather, the division of $\frac{1}{8}$ is performed by logically right-shifting by three binary places and the multiplication by the factor of $\frac{7}{8}$ is obtained by copying the original threshold value, logically right-shifting the threshold value by three binary places and subtracting the right-shifted value from the copied value. Although the digital filter has a "time constant" of eight samples, since upon reset the threshold array THRESH(Y,K) could have any set of initial values, the digital filter in step 111 is turned on for sixty-four scans of the matrix 24 in order to obtain a stable final value.

After the initial calculation in step 111, the threshold is updated in step 112 over a much longer time constant of about 256 samples. So that the threshold will track the surrounding background illumination, regardless of whether the operator is entering data by covering the light-emitting diodes, the accumulation in the digital filter is inhibited in response to the measured intensity IN(K) being less than the corresponding threshold value THRESH(Y,K).

In view of the above, a method and apparatus has been described of the kind having light-emitting diodes for a display of input data, in which any fall-off in the photo-current produced in the light-emitting diodes by surrounding illumination is detected and evaluated as an input signal. For manual data entry, for example, the operator covers a selected light-emitting diode with his finger tip causing the photo-current produced in a light-emitting diode to be interrupted, and the interruption in photo-current is detected by an electronic monitoring circuit. By using a microcomputer in the monitoring circuit, the light intensity threshold for each of the light-emitting diodes can be independently set and updated over time during operation of the apparatus. This adaptive adjustment of the threshold also compensates for any leakage currents or offsets in the circuitry. By using digital filtering techniques, the reliability of data entry is ensured. By using row and column addressing of the diode matrix, the microcomputer can service a large array of light-emitting diodes for the display and entry of data. Therefore, external input devices such as a light pen are unnecessary.

I claim as my invention:

1. An apparatus for the input and display of data of the kind having at least one light-emitting diode and means for selectively applying current to said light-emitting diode to display to an operator at least some of said data, wherein the improvement comprises, in combination, said means for selectively applying current provides means for repetitively limiting the applied current to said light-emitting diode, and means responsive to a photo-current produced by said light-emitting diode in response to surrounding illumination for generating at least some of said data when said means for selectively applying current repetitively limits said applied current so that said light-emitting diode functions both as a data display device and as a data input device responsive to the covering of said light-emitting diode by said operator.

2. The apparatus as claimed in claim 1, wherein the data displayed by said light-emitting diode is based upon the data generated by said means responsive to the photo-current.

3. The apparatus as claimed in claim 2, wherein said means for selectively applying current applies current far in excess of said photo-current to said light-emitting diode to display a first binary logic state of an output bit of said data and limits the applied current to less than approximately the same order of magnitude as a said photo-current to display a second binary logic state of said output bit of said data, and wherein said means responsive to the photo-current generates first and second binary states of an input bit of said data in response to said photo current.

4. The apparatus as claimed in claim 1, wherein said means for selectively applying current applies current far in excess of said photo-current to said light-emitting diode to display a first binary logic state of an output bit of said data and limits the applied current to less than approximately the same order of magnitude as said photo-current to display a second binary logic state of said output bit of said data, and wherein said means responsive to the photo-current generates first and second binary states of an input bit of said data in response to said photo-current.

5. The apparatus as claimed in claim 4, wherein said means for selectively applying current repetitively limits the applied current to said light-emitting diode independent of the displayed data for durations so short that for said first logic state of said output bit the temporary extinction of light emitted from said light-emitting diode cannot be perceived by the human eye.

6. The apparatus as claimed in claim 1, wherein the illumination surrounding said light-emitting diode is just ambient illumination from conventional light sources apart from said apparatus.

7. The apparatus as claimed in claim 1, wherein said light-emitting diode is part of an array of light-emitting diodes, each diode in said array including a respective means for selectively applying current to said diode to display the binary logic state of a corresponding output bit of said data, and further comprising a multiplexer under control of a clock circuit for sequentially connecting the light-emitting diodes to said means responsive to the photo-current, the clock circuit also including means for inhibiting the respective means for applying current to the diode being connected to said means responsive to the photo-current.

8. The apparatus as claimed in claim 1, wherein said means responsive to the photo-current includes a current-to-voltage converter.

9. A control system for receiving data from a machine operator for the adjustment of an inking unit of a rotary printing machine, said control system including light-emitting diodes for displaying said data received from the machine operator, wherein the improvement comprises, means for sensing a photo-current produced by the light-emitting diodes in response to surrounding illumination and receiving from said machine operator said data by detecting the fall-off in said photo-current caused by the operator's covering of selected ones of the light-emitting diodes.

10. The control system as claimed in claim 9, wherein the covering of a chosen one of the light-emitting diodes to change the data having been received from the machine operator is indicated by a change in light emitted by said chosen one of the light-emitting diodes.

11. The control system as claimed in claim 9, further comprising a multiplexer under control of a clock circuit for repetitively connecting the light-emitting diodes in a predetermined sequence to a monitoring circuit for monitoring the photocurrent, and wherein each light-emitting diode is disconnected from a lighting voltage source when the light-emitting diode is connected to said monitoring circuit.

12. The control system as claimed in claim 11, wherein the duration of the disconnection of each light-emitting diode from the lighting voltage source when the light-emitting diode is connected to said monitoring circuit is so short that temporary extinction of light for such a duration is beyond the limits of human visual perception.

13. The control system as claimed in claim 9, wherein each light-emitting diode is alternately connected via respective parallel switching circuits to a lighting voltage source and to a monitoring circuit for detecting said fall-off in said photo-current.

14. The control system as claimed in claim 13, further comprising a current-to-voltage converter connected in series with said monitoring circuit for converting said photo-current to a corresponding voltage to which said monitoring circuit is responsive.

15. A method for using a light-emitting diode both for receiving data from an operator to change the logic state of a device and for displaying the entered data back to the operator comprising the steps of:

(1) selectively applying current to energize the light-emitting diode to emit light in accordance with said logic state of said device, and (2) using said light-emitting diode as a photo-sensitive device for sensing surrounding illumination, receiving from said operator said data by detecting the fall-off in said surrounding illumination sensed by said light-emitting diode when the operator selectively covers the light-emitting diode, and changing the logic state of said device in response to said data received from said operator.

16. The method as claimed in claim 15, further comprising the step of repetitively limiting the current selectively applied to said light-emitting diode, and wherein said fall-off in said surrounding illumination is detected when the current selectively applied to the light-emitting diode is repetitively limited.

17. The method as claimed in claim 16, wherein the current selectively applied is reptitively limited for durations so short that temporary extinction of light for such a duration is beyond the limits of human visual perception.

* * * * *